US006411027B1

(12) United States Patent
Sluyterman et al.

(10) Patent No.: US 6,411,027 B1
(45) Date of Patent: Jun. 25, 2002

(54) COLOR DISPLAY DEVICE HAVING QUADRUPOLE CONVERGENCE COILS

(75) Inventors: Albertus A. S. Sluyterman; Nicolaas G. Vink; Tjerk G. Spanjer; Leopold C. M. Beirens, all of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/338,049

(22) Filed: Jun. 22, 1999

Related U.S. Application Data

(63) Continuation-in-part of application No. 09/218,550, filed on Dec. 22, 1998.

(30) Foreign Application Priority Data

Dec. 29, 1997 (EP) ..... 97204128

(51) Int. Cl.[7] ..... H01J 29/70

(52) U.S. Cl. ..... 313/440; 313/412; 313/426; 335/210; 335/213

(58) Field of Search ..... 313/440, 412, 313/426, 428; 335/210, 213

(56) References Cited

U.S. PATENT DOCUMENTS

| | | | | |
|---|---|---|---|---|
| 3,806,757 A | 4/1974 | Saruta | ..... | 315/13 |
| 5,027,042 A | 6/1991 | Sluyterman et al. | ..... | 315/368 |
| 5,070,280 A | 12/1991 | Okuyama et al. | ..... | 315/368.11 |
| 5,248,920 A | 9/1993 | Gioia et al. | ..... | 315/368.26 |
| 5,512,802 A | 4/1996 | Jamar | ..... | 315/368.25 |
| 5,565,732 A | 10/1996 | Sluyterman et al. | ..... | 313/440 |

FOREIGN PATENT DOCUMENTS

| | | | | |
|---|---|---|---|---|
| EP | 0382299 A1 | 8/1990 | ..... | H01J/29/70 |
| EP | 0421523 A1 | 4/1991 | ..... | H01J/29/56 |
| EP | 0507383 A1 | 10/1992 | ..... | H01J/29/56 |
| WO | WO9708729 | 3/1997 | ..... | H01J/29/70 |
| WO | WO9802035 | 1/1998 | ..... | A01K/31/04 |

*Primary Examiner*—Nimeshkumar D. Patel
*Assistant Examiner*—Kevin Quarterman

(57) ABSTRACT

The invention relates to a color display device comprising an in-line electron gun (5) for generating three electron beams (6,7,8), and a convergence unit (14') to dynamically influence the convergence of the electron beams, preferably to decrease a distance (p) between the electron beams. The convergence unit (14') comprises a ring-shaped element (21') having four coils (22'). The coils (22') comprise electrically conductive wires, which have been toroidally wound in a winding direction and according to a winding density distribution N (ϕ) given by N (ϕ)=$N_0$ cos (2ϕ). Here ϕ is an angle enclosed by the X-direction and a line between an element of the coil and the center, which ranges between 0° and 360°, $N_0$ is the winding density at ϕ equal to 0°, and the sign of N ϕ denotes the winding direction.

4 Claims, 2 Drawing Sheets

COLOR DISPLAY DEVICE HAVING QUADRUPOLE CONVERGENCE COILS

CROSS-REFERENCE TO RELATED APPLICATIONS

This is a continuation-in-part of copending patent application Ser. No. 09/218,550, filed Dec. 22, 1998, which is hereby incorporated by reference.

BACKGROUND OF THE INVENTION

The invention relates to a color display device comprising an in-line electron gun for generating three electron beams, and a unit for deflecting the electron beams across the color selection electrode.

Such display devices are known.

A present aim is to make the outer surface of the display window flatter, so that the image represented by the color display device is perceived by the viewer as flat. However, an increase of the radius of curvature of the outer surface will lead to an increase of a number of problems. The radius of curvature of the inner surface of the display window and of the color selection electrode should increase, and, as the color selection electrode becomes flatter, the strength of the color selection electrode decreases and hence the sensitivity to doming and vibrations increases. An alternative solution to this problem would be to curve the inner surface of the display window more strongly than the outer surface. By virtue thereof, a color selection electrode having a relatively small radius of curvature can be used. As a result, doming and vibration problems are reduced, however other problems occur instead. The thickness of the display window is much smaller in the center than at the edges. As a result, the weight of the display window increases and the intensity of the image decreases substantially towards the edges.

EP 0,421,523 discloses a color cathode ray tube with an in-line gun, a pin cushion correcting yoke and an eyebrow effect electronoptical distortion correction device comprising two pairs of coils, each pair having a coil on each outer electron beam side of the neck in the plane of the beams. The coil pairs are spaced apart along the z-axis between the gun and the yoke and are driven by a sawtooth current having a bow-tie envelope synchronous with the raster scan to correct the dynamic, antisymmetrical eyebrow effect apparent as a purity defect on the raster.

The non-prepublished applications PCT/IB98/02035 and U.S. Ser. No. 09/218550 describe a color display device comprising a color cathode ray tube including an in-line electron gun for generating three electron beams being located substantially within a plane extending in an X-direction of a rectangular X-Y coordinate system, a color selection electrode, deflecting means for deflecting the electron beams located at a deflection plane, and first and second influencing means to dynamically influence the convergence of the electron beams, to decrease a distance between the electron beams at a location of the deflection plane.

These and other objects of the invention will be apparent from and elucidated with reference to the embodiments described hereinafter.

BRIEF DESCRIPTION OF THE DRAWING

In the drawing.

The figures are not drawn to scale. In the figures, like reference numerals generally refer to like parts.

Figure 1:
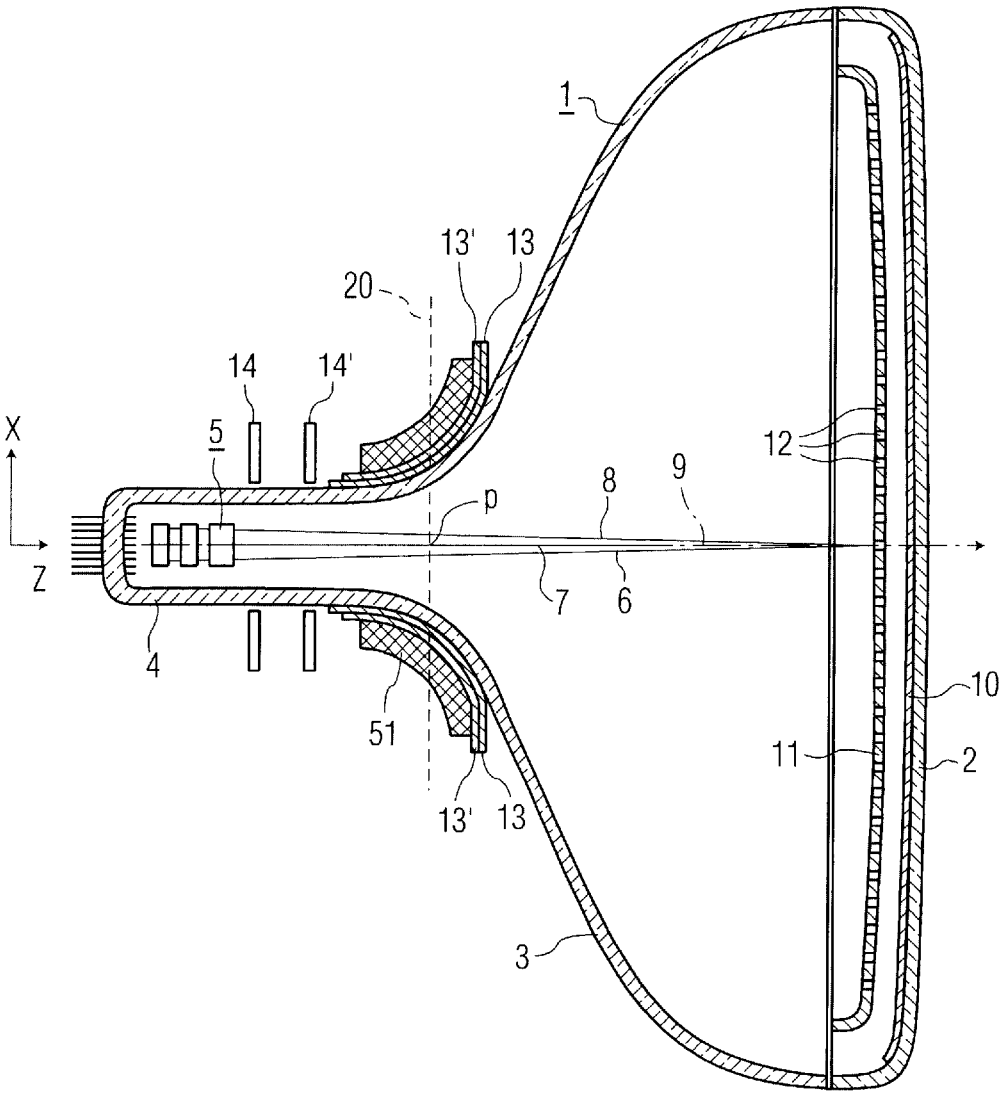
FIG. 1 is a sectional view of a display device, in which the invention is schematically shown.

The display device shown in FIG. 1 comprises a cathode ray tube, in this example a color display tube, having an evacuated envelope 1 which includes a display window 2, a cone portion 3 and a neck 4. In the neck 4 there is arranged an in-line electron gun 5 for generating three electron beams 6, 7 and 8 which extend in one plane, the in-line plane, which is in this case the plane of the drawing. In the undeflected state, the central electron beam 7 substantially coincides with the tube axis 9.

The inner surface of the display window is provided with a display screen 10. The display screen 10 comprises a large number of phosphor elements luminescing in red, green and blue. On their way to the display screen, the electron beams are deflected across the display screen by way of an electromagnetic deflection unit 51 and pass through a color selection electrode 11 which is arranged in front of the display window 2 and which comprises a thin plate having apertures 12. The three electron beams 6, 7 and 8 pass through the apertures 12 of the color selection electrode at a small angle relative to each other and hence each electron beam impinges only on phosphor elements of one color. The deflection unit 51 comprises, in addition to a coil holder 13, deflection coils 13' for deflecting the electron beams in two mutually perpendicular directions. The display device further includes means for generating voltages, which during operation are fed to components of the electron gun via feedthroughs. The deflection plane 20 is schematically indicated as well as the distance p between the electron beams 6 and 8 in this plane.

The color display device comprises two electron beam convergence influencing units 14, 14', whereby a first unit 14 is used, in operation, to dynamically bend, i.e. as a function of the deflection in a direction, the outermost electron beams towards each other, and a second unit 14' serves to dynamically bend the outermost electron beams in opposite directions.

The two units 14, 14' are positioned at some distance from each other, and are used to vary the distance p, as a function of the deflection, in a such a manner that the distance p decreases as a function of the deflection in at least one direction. The first unit 14 is positioned close to the gun and will be referred to as the "gun quadrupole", whereas the second unit 14' is located near the deflection unit and will be referred to as the "yoke quadrupole".

The second convergence unit 14'("the yoke ring quadrupole") is obtained by making the coils 22' from electrically conductive wires, which are toroidally wound in a winding direction and according to a winding density distribution N (ϕ) given by $$N(\phi)=N_0\cos(2\phi);$$

where ϕ is an angle enclosed by the X-direction and a line between an element of the coil and the center, which ranges between 0° and 360°, $N_0$ is the winding density at ϕ equal to 0°, and the sign of N (ϕ) denotes the winding direction.

This embodiment has the advantage that an almost pure quadrupole field can be generated, i.e. the presence of other magnetic multiple fields is largely suppressed.

Figure 2A:
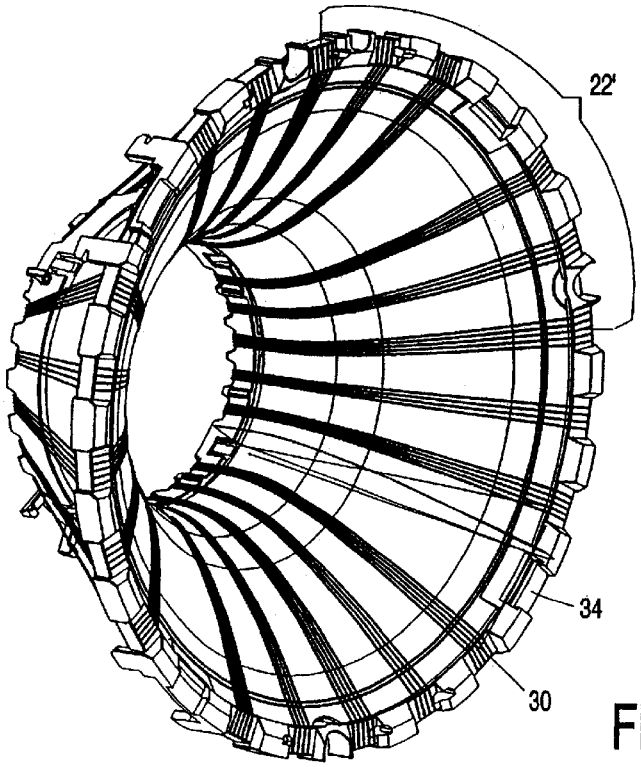
FIGS. 2A, 2B show an embodiment of the second convergence unit according to the invention.
Figure 2B:
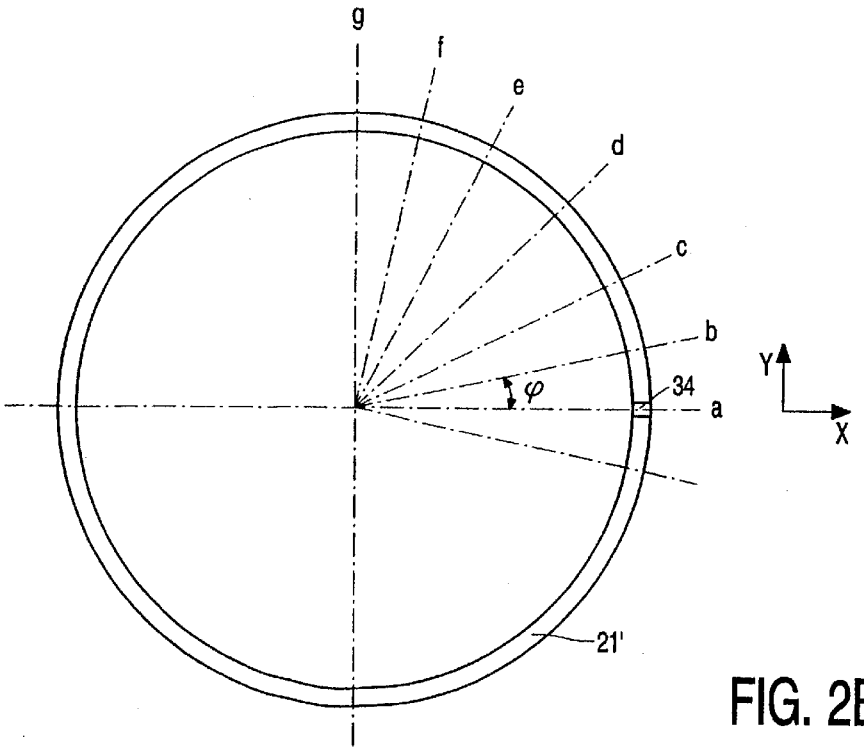

In practice, due to the finite dimensions of the wire only an approximation of the above winding density can be realized. An embodiment of such an approximation is shown in FIGS. 2A and 2B. This embodiment comprises packages 30 of electrically conductive wires, which are toroidally wound around a yoke ring 21' according to the above winding density $N(\phi)=N_0\cos(2\phi)$.

In this particular embodiment windings have been made in grooves 34 of yoke ring 21' that are spaced 15 degrees apart. The winding method is as follows:

18 windings in a groove at $\phi$=0 degrees (position a), 15 windings in a groove at $\phi$=15 degrees (position b), 9 windings at $\phi$=30 degrees (position c), no windings at $\phi$=45 degrees (position d), 9 windings with current in an opposing direction in a groove at $\phi$=60 degrees (position e), 15 windings at $\phi$=75 degrees (position f), 18 windings at $\phi$=90 degrees (position g), etc.

This approximation to the ideal winding density N ($\phi$) has proven in practice to give good results.

A preferred method of manufacturing the second convergence unit 14' ("the yoke ring quadrupole"), where the coils 22' comprise layers, comprises the steps of: providing a ring-shaped element 21' and winding electrically conductive wire toroidally around the ring-shaped element 21'. The winding step comprises of a first step winding a first layer of each of the coils, and at least one further step, of winding a further layer of each of the coils.

This method of winding the second convergence unit is different from a simpler method in which the coils are wound in one layer. The simpler method however, may cause ringing problems as well as reliability problems. Ringing is an unwanted inductive interference phenomenon between line and frame coils 13' of the deflection unit 51. The preferred method of winding according to the invention is visible by the many interconnection wires between the four coils 22.

In summary, a preferred embodiment of the invention relates to a color display device comprising an in-line electron gun 5 for generating three electron beams 6,7,8, and a convergence unit 14' to dynamically influence the convergence of the electron beams, to decrease a distance p between the electron beams. The convergence unit 14' comprises a ring-shaped element 21' having four coils 22'. The coils 22' comprise electrically conductive wires, which are toroidally wound in a winding direction and according to a winding density distribution N ($\phi$) given by N ($\phi$)=$N_0$ cos ($2\phi$); where $\phi$ is an angle enclosed by the X-direction and a line between an element of the coil and the center, which ranges between 0° and 360°, $N_0$ is the winding density at $\phi$ equal to 0°, and the sign of N ($\phi$) denotes the winding direction.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of other elements or steps than those listed in a claim. The word "a" or "an" preceding an element does not exclude the presence of a plurality of such elements.

What is claimed is:

1. A color display device comprising an in-line electron gun (5) for generating three electron beams (6,7,8) being located substantially within a plane extending in an X-direction of a rectangular X-Y coordinate system, deflecting means (51) for deflecting the electron, and convergence means (14') for dynamically influencing the convergence of the electron beams, the convergence means (14') comprising a ring-shaped element (21') having four coils (22'), said coils (22') comprising electrically conductive wires, which have been toroidally wound in a winding direction and according to a winding density distribution N ($\phi$) given by N ($\phi$)=$N_0$ cos ($2\phi$); where $\phi$ is an angle enclosed by the X-direction and a line between an element of the coil and the center, which ranges between 0° and 360°, $N_0$ is the winding density at $\phi$ equal to 0°, and the sign of N ($\phi$) denotes the winding direction.

2. A color display device according to claim 1, wherein the coils (22') of the convergence means (14') comprise packages (30) of electrically conductive wires, said packages (30) being toroidally wound in a winding direction and according to an approximate winding density distribution N ($\phi$) described by N ($\phi$)=$N_0$ cos ($2\phi$); where $\phi$ is an angle enclosed by the X-direction and a line between an element of the package and the center.

3. A color display device according to claim 1, wherein each coil has layers comprising a first layer of each of the coils and at least one further layer of each of the coils.

4. A deflection unit (51) comprising deflection coils (13') and convergence means (14') to dynamically influence the convergence of electron beams (6,7,8), to decrease a distance (p) between the electron beams at a location of a deflection plane, the convergence means (14') comprising a ring-shaped element (21') having four coils (22'), said coils (22') comprising electrically conductive wires, which have been toroidally wound in a winding direction and according to a winding density distribution N ($\phi$) given by N ($\phi$)=$N_0$ cos ($2\phi$); where $\phi$ is an angle enclosed by the X-direction and a line between an element of the coil and the center, which ranges between 0° and 360°, $N_0$ is the winding density at $\phi$ equal to 0°, and the sign of N ($\phi$) denotes the winding direction.

* * * * *